US012011061B2

(12) United States Patent
Linkfield et al.

(10) Patent No.: US 12,011,061 B2
(45) **Date of Patent: *Jun. 18, 2024**

(54) FOOTWEAR AND SOLE STRUCTURE ASSEMBLIES WITH ADHESIVE-FREE MECHANICAL ATTACHMENTS BETWEEN INSOLES AND MIDSOLES

(71) Applicant: NIKE, Inc., Beaverton, OR (US)

(72) Inventors: Brian Linkfield, Lake Oswego, OR (US); Darryl Matthews, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/155,820

(22) Filed: Jan. 18, 2023

(65) Prior Publication Data

US 2023/0148707 A1 May 18, 2023

Related U.S. Application Data

(63) Continuation of application No. 17/104,484, filed on Nov. 25, 2020, now Pat. No. 11,576,467, which is a (Continued)

(51) Int. Cl.
*A43B 13/12* (2006.01)
*A43B 9/16* (2006.01)

(Continued)

(52) U.S. Cl.
CPC ..... *A43B 13/28* (2013.01); *A43B 9/16* (2013.01); *A43B 13/12* (2013.01); *A43B 13/127* (2013.01);

(Continued)

(58) Field of Classification Search
CPC ..... A43B 13/12; A43B 13/125; A43B 13/127; A43B 13/16

(Continued)

(56) References Cited

U.S. PATENT DOCUMENTS 4,222,185 A * 9/1980 Giaccaglia ..... A43B 3/108 36/11.5
4,798,010 A * 1/1989 Sugiyama ..... A43B 13/187 36/31

(Continued)

*Primary Examiner* — Marie D Bays
(74) *Attorney, Agent, or Firm* — Quinn IP Law

(57) ABSTRACT

Presented are footwear sole structures with foot-cushioning insoles movably mounted onto impact-attenuating midsoles, methods for making/using such sole structures, and footwear fabricated with such sole structures. A multilayered sole structure assembly includes an insole movably mounted on a midsole. The midsole is formed with a first compressible material and includes opposing upper and lower midsole surfaces, multiple protrusions projecting from the upper midsole surface, and multiple pockets recessed into the upper midsole surface and interleaved with the midsole protrusions. The insole, which is formed with a second compressible material distinct from the first compressible material, includes opposing upper and lower insole surfaces, multiple protrusions projecting from the lower insole surface and interleaved with the midsole protrusions, and multiple pockets recessed into the lower insole surface and interleaved with the insole protrusions. Each midsole protrusion nests within a respective insole pocket, while each insole protrusion nests within a respective midsole pocket.

20 Claims, 6 Drawing Sheets

Related U.S. Application Data continuation of application No. 16/288,871, filed on Feb. 28, 2019, now Pat. No. 10,874,169.

(51) Int. Cl.

| | |
|---|---|
| ***A43B 13/16*** | (2006.01) |
| ***A43B 13/18*** | (2006.01) |
| ***A43B 13/22*** | (2006.01) |
| ***A43B 13/28*** | (2006.01) |

(52) U.S. Cl.
CPC ..... *A43B 13/16* (2013.01); *A43B 13/188* (2013.01); *A43B 13/223* (2013.01)

(58) Field of Classification Search
USPC ..... 36/25 R, 31, 30 R
See application file for complete search history.

(56) References Cited

U.S. PATENT DOCUMENTS 5,331,750 A * 7/1994 Sasaki ..... F16F 1/376 267/80
7,950,167 B2 * 5/2011 Nakano ..... A43B 13/186 36/28
11,576,467 B2 * 2/2023 Linkfield ..... A43B 7/1405
2001/0052194 A1 * 12/2001 Nishiwaki ..... A43B 7/144 36/35 R
2004/0181970 A1 * 9/2004 Covatch ..... A43B 17/00 36/28
2005/0000116 A1 * 1/2005 Snow ..... A43B 3/128 36/28
2007/0186446 A1 * 8/2007 Lafortune ..... A43B 13/125 36/43
2007/0277401 A1 * 12/2007 Young-Chul ..... A43B 13/186 36/28
2012/0210606 A1 * 8/2012 Gheorghian ..... A43B 13/127 36/103
2016/0021972 A1 * 1/2016 Grelle ..... A43B 7/1415 36/140
2017/0238652 A1 * 8/2017 Langvin ..... A43B 13/141
2017/0340058 A1 * 11/2017 Madore ..... A43B 7/146
2019/0239596 A1 * 8/2019 Ploem ..... A43B 23/042
2019/0261737 A1 * 8/2019 Walsh ..... A43B 13/18
2020/0046068 A1 * 2/2020 Choi ..... A43B 13/125
2020/0121022 A1 * 4/2020 Edwards ..... A43B 13/026
2020/0170335 A1 * 6/2020 Horvath ..... A43B 3/0047
2020/0275739 A1 * 9/2020 Linkfield ..... A43B 13/127
2020/0305544 A1 * 10/2020 Cross ..... A43B 13/14
2021/0315319 A1 * 10/2021 Klein ..... A43B 13/127

* cited by examiner

FOOTWEAR AND SOLE STRUCTURE ASSEMBLIES WITH ADHESIVE-FREE MECHANICAL ATTACHMENTS BETWEEN INSOLES AND MIDSOLES

CLAIM OF PRIORITY AND CROSS-REFERENCE TO RELATED APPLICATIONS

This application is a continuation of U.S. patent application Ser. No. 17/104,484, which was filed on Nov. 25, 2020, is now allowed, and is a continuation of U.S. patent application Ser. No. 16/288,871, which was filed on Feb. 28, 2019, and is now U.S. Pat. No. 10,874,169 B2. All of the foregoing patent matters are incorporated herein by reference in their respective entireties and for all purposes.

TECHNICAL FIELD

The present disclosure relates generally to articles of footwear. More specifically, aspects of this disclosure relate to footwear with multilayered sole structures having impact-attenuating midsoles, wear-reducing outsoles, and foot-cushioning insoles.

BACKGROUND

Articles of footwear, such as shoes, boots, slippers, sandals, and the like, are generally composed of two primary elements: an upper for securing the footwear to a user's foot; and a sole for providing subjacent support to the foot. Uppers may be fabricated from a variety of materials, including textiles, foams, polymers, natural and synthetic leathers, etc., that are stitched or bonded together to form a shell or harness for securely receiving a foot. Many sandals and slippers have an upper with an open toe or heel construction, with some designs incorporating an upper that is limited to a series of straps extending over the instep and, optionally, around the ankle. Conversely, boot and shoe designs employ a full upper with a closed toe and heel construction that encases the foot. An ankle opening through a rear quarter portion of the footwear provides access to the footwear's interior, facilitating entry and removal of the foot into and from the upper. A shoelace or strap may be utilized to secure the foot within the upper.

A sole structure is generally attached to the underside of the upper, positioned between the user's foot and the ground. In many articles of footwear, including athletic shoes and boots, the sole structure is a layered construction that generally incorporates a comfort-enhancing insole, an impact-mitigating midsole, and a surface-contacting outsole. The insole, which may be located partially or entirely within the upper, is a thin and compressible member that provides a contact surface for the underside "plantar" region of the user's foot. By comparison, the midsole is mounted underneath the insole, forming a middle layer of the sole structure. In addition to attenuating ground reaction forces, the midsole may help to control foot motion and impart enhanced stability. Secured underneath the midsole is an outsole that forms the ground-contacting portion of the footwear. The outsole is usually fashioned from a durable, waterproof material that includes tread patterns engineered to improve traction.

SUMMARY

Presented herein are footwear sole structures with foot-cushioning insoles movably mounted onto impact-attenuating midsoles, methods for making and methods for using such sole structures, and articles of footwear fabricated with such sole structures. By way of example, and not limitation, an athletic shoe is disclosed that includes a multilayered sole structure assembly having a compressible polymer foam insole ("core") with an adhesive-free mechanical attachment to a polymer-foam based midsole ("carrier"). A multi-piece, synthetic-rubber outsole may be inlaid at discrete locations along a downward facing, ground-contacting surface of the midsole. In this representative assembly, the insole and midsole are independently molded as distinct, single-piece structures with the insole movably mounted inside the midsole. The midsole and insole nest together via complementary "egg-crate" geometries, with prolate-spheroid-shaped protrusions projecting from an upward facing surface of the midsole and interleaving with prolate-spheroid-shaped protrusions projecting from a downward facing surface of the insole. Distal ends of the prolate-spheroid-shaped protrusions nest flush within complementary pockets recessed into the facing structure of the opposing sole structure element. The respective heights and widths of these protrusions may be distinct from one another, varying in both fore-aft and medio-lateral directions of the footwear.

Nubs projecting upward from distal tips of the midsole's protrusions extend through complementary holes in the insole. In addition to maintaining proper longitudinal and lateral alignment of the insole within the midsole, these nubs cooperate with the egg-crate interface to allow the insole to "float" on top of the midsole. Moreover, the nubs may have rounded tips and may be arranged in an engineered pattern that gives a "foot massaging" proprioceptive response for the user. The aforementioned mechanical engagement eliminates the need for adhesives and fasteners to join together the insole and midsole. However, the sole structure assembly may be attached to the upper via adhesives and/or fasteners, e.g., along an inner perimeter of an upwardly extending sidewall of the midsole. For at least some designs, an outer periphery of the insole is sandwiched between the midsole and upper, helping to retain the insert in place while not obstructing the footbed portion of the insole against which the user's foot rests. The midsole foam composition may absorb about 30% or less of compression forces imparted by the user to provide a softer feel with 15-20% more energy return compared to comparable foam sole structures.

Aspects of this disclosure are directed to multilayered footwear sole structures with foot-cushioning insoles coupled to impact-attenuating midsoles via complementary, intermeshing convoluted surfaces. In an example, a sole structure for an article of footwear includes an insole that is movably mounted—or "floats"—on a subjacent midsole. The midsole is formed, in whole or in part, from a compressible (first) material having an engineered (first) hardness. The midsole has a ground-facing lower surface opposite a foot-facing upper surface. Multiple (first) protrusions project upwardly from the midsole's upper surface, and multiple (first) pockets are recessed into the midsole's upper surface and interleaved with the midsole's protrusions. The insole is formed, in whole or in part, from a compressible (second) material having an engineered (second) hardness that is less than the hardness of the midsole. The insole has opposing upper and lower surfaces with multiple (second) protrusions projecting downwardly from the insole's lower surface and interleaved with the midsole's protrusions. Multiple (second) pockets are recessed into the insole's lower surface and interleaved with the insole's protrusions. Each midsole protrusion nests within one of the insole's pockets, while each insole protrusion nests within one of the midsole's pockets.

Other aspects of this disclosure are directed to footwear fabricated with any of the disclosed multilayered sole structure assemblies. As an example, an article of footwear includes an upper that receives and attaches to a foot of a user, and a sole structure that is attached to the upper to support thereon the user's foot. The sole structure includes a midsole, an insole movably mounted on the midsole, and an optional outsole rigidly mounted along the underside of the midsole. The midsole, which is formed with a compressible polymeric material, includes a ground-facing lower midsole surface opposite an upper midsole surface. Multiple protrusions project from the upper midsole surface, and multiple pockets are recessed into the upper midsole surface and interleaved with the first protrusions. The insole is formed with a distinct compressible polymeric material having a hardness that is less than the hardness of the midsole material. The insole has an upper insole surface opposite a lower insole surface, multiple protrusions projecting from the lower insole surface and interleaved with the midsole's protrusions, and multiple pockets recessed into the lower insole surface and interleaved with the insole's protrusions. Each midsole protrusion nests within a respective one of the insole's pockets, whereas each insole protrusion nests within a respective one of the midsole's pockets.

Additional aspects of this disclosure are directed to methods for manufacturing and methods for using any of the disclosed footwear and/or sole structures. In an example, a method is presented for manufacturing a sole structure for an article of footwear. This representative method includes, in any order and in any combination with any of the above or below disclosed features and options: forming, using a first material having a first hardness, a midsole having opposing upper and lower midsole surfaces, multiple first protrusions projecting from the upper midsole surface, and multiple first pockets recessed into the upper midsole surface and interleaved with the first protrusions; forming, using a second material having a second hardness less than the first hardness, an insole having opposing upper and lower insole surfaces, multiple second protrusions projecting from the lower insole surface and interleaved with the first protrusions, and multiple second pockets recessed into the lower insole surface and interleaved with the second protrusions; and mounting the insole onto the midsole such that each of the first protrusions is nested within a respective one of the second pockets, and each of the second protrusions is nested within a respective one of the first pockets.

For any of the disclosed sole structures, footwear, and manufacturing methods, each midsole protrusion may sit substantially flush against its respective insole pocket, whereas each insole protrusion may sits substantially flush against its respective midsole pocket. While innumerable shapes, sizes and orientations are envisioned, each protrusion may have a prolate-spheroid shape with a rectangular base. Moreover, a plurality of the midsole protrusions may each have a distinct height, and a plurality of the insole protrusions may each have a distinct height. In the same vein, a plurality of the midsole protrusions may each have a distinct width, and a plurality of the insole protrusions may each have a distinct width. Optionally, the midsole's protrusions and pockets may be arranged in a series of mediolateral rows that extend transversely across the midsole. Likewise, the insole protrusions and pockets may be arranged in a series of mediolateral rows that extend transversely across the insole.

For any of the disclosed sole structures, footwear, and manufacturing methods, a subset of the midsole's protrusions may each include a respective nub that projects upwardly from a distal tip thereof. A corresponding subset of the insole's pockets may each include a respective hole that receives therein one of these nubs. In at least some configurations, the holes in the insole have a first width, and the nubs of the midsole protrusions have a second width greater than the first width. In so doing, press fitting the nubs into the holes creates an interference fit coupling between the insole and midsole. As a further option each nub may extend all the way through its respective hole from the lower insole surface to the upper insole surface. While innumerable shapes, sizes and orientations are envisioned, each nub may have a cylindrical body with a rounded tip that protrudes from the insole's upper surface.

For any of the disclosed sole structures, footwear, and manufacturing methods, the midsole may be fabricated with a stepped shelf that extends substantially continuously around and circumscribes the midsole's upper surface. The insole may be fabricated with a flange that extends substantially continuously around and circumscribes the insole's lower surface. When the insole is properly mounted on the midsole, the insole's flange is buttressed on the midsole's stepped shelf. While not per se required, any of the disclosed sole structure assemblies may include an outsole that is formed, in whole or in part, from a third material that is harder than the insole and midsole materials. The outsole may be mounted to the ground-facing lower surface of the midsole. The outsole may be molded as a bipartite structure from a synthetic rubber. Optionally, the midsole may be molded as a distinct, single-piece structure from one polymer foam material, and the insole may be molded as a distinct, single-piece structure from another polymer foam material. An optional toe shield formed from a wear-resistant polymeric material may be mounted on a front end of the midsole. It is envisioned that any suitable manufacturing technique may be used to fabricate a disclosed sole structure assembly or a constituent part thereof, including injection, compression and/or multi-shot molding.

The above summary is not intended to represent every embodiment or every aspect of the present disclosure. Rather, the foregoing summary merely provides an exemplification of some of the novel concepts and features set forth herein. The above features and advantages, and other features and attendant advantages of this disclosure, will be readily apparent from the following detailed description of illustrated examples and representative modes for carrying out the present disclosure when taken in connection with the accompanying drawings and the appended claims. Moreover, this disclosure expressly includes any and all combinations and subcombinations of the elements and features presented above and below.

Figure 1:
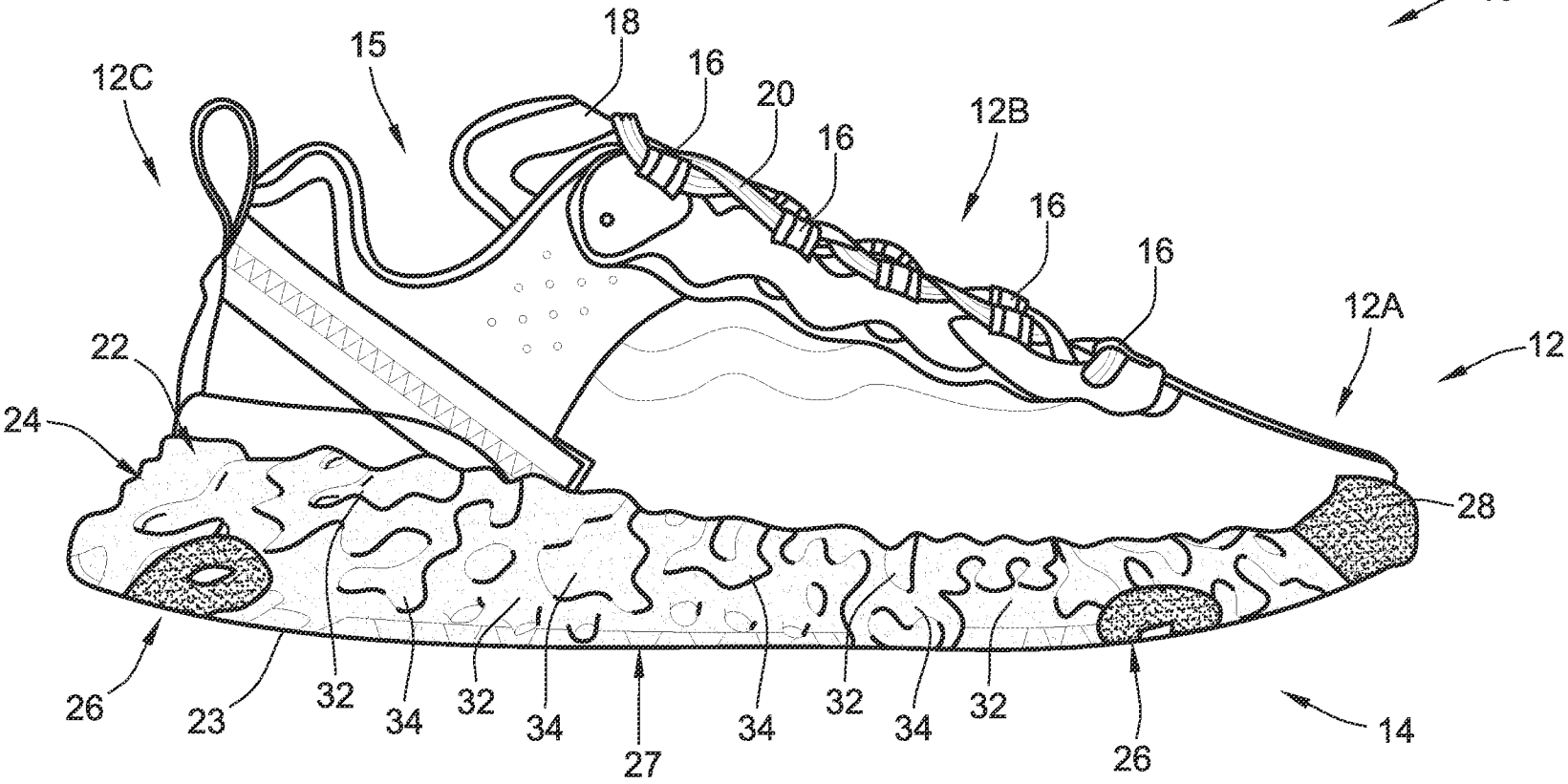
FIG. 1 is a lateral side-view illustration of a representative article of footwear with a multilayered sole structure assembly in accordance with aspects of the present disclosure.

The present disclosure is amenable to various modifications and alternative forms, and some representative embodiments are shown by way of example in the drawings and will be described in detail herein. It should be understood, however, that the novel aspects of this disclosure are not limited to the particular forms illustrated in the above-enumerated drawings. Rather, the disclosure is to cover all modifications, equivalents, combinations, subcombinations, permutations, groupings, and alternatives falling within the scope of this disclosure as encompassed by the appended claims.

DETAILED DESCRIPTION

This disclosure is susceptible of embodiment in many different forms. Representative examples of the disclosure are shown in the drawings and will be described in detail herein with the understanding that these representative examples are provided as an exemplification of the disclosed principles, not limitations of the broad aspects of the disclosure. To that extent, elements and limitations that are described in the Abstract, Technical Field, Background, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including," "comprising," "having," "containing," and the like shall each mean "including without limitation." Moreover, words of approximation, such as "about," "almost," "substantially," "approximately," and the like, may be used herein in the sense of "at, near, or nearly at," or "within 0-5% of," or "within acceptable manufacturing tolerances," or any logical combination thereof, for example. Lastly, directional adjectives and adverbs, such as fore, aft, medial, lateral, proximal, distal, vertical, horizontal, front, back, left, right, etc., may be with respect to an article of footwear when worn on a user's foot and operatively oriented with a ground-engaging portion of the sole structure seated on a flat surface, for example.

Referring now to the drawings, wherein like reference numbers refer to like features throughout the several views, there is shown in FIG. 1 a representative article of footwear, which is designated generally at 10 and portrayed herein for purposes of discussion as an athletic shoe or "sneaker." The illustrated article of footwear 10—also referred to herein as "footwear" or "shoe" for brevity—is an exemplary application with which novel aspects and features of this disclosure may be practiced. In the same vein, implementation of the present concepts for a trilayer, polymer sole structure assembly should also be appreciated as a representative implementation of the disclosed concepts. It will therefore be understood that aspects and features of this disclosure may be utilized for sole structures with alternative chemical makeups and/or sole structures with different layer compositions, and may be incorporated into any logically relevant type of footwear. As used herein, the terms "shoe" and "footwear," including permutations thereof, may be used interchangeably and synonymously to reference any suitable type of garment worn on a human foot. Lastly, features presented in the drawings are not necessarily to scale and are provided purely for instructional purposes. Thus, the specific and relative dimensions shown in the drawings are not to be construed as limiting.

Figure 2:
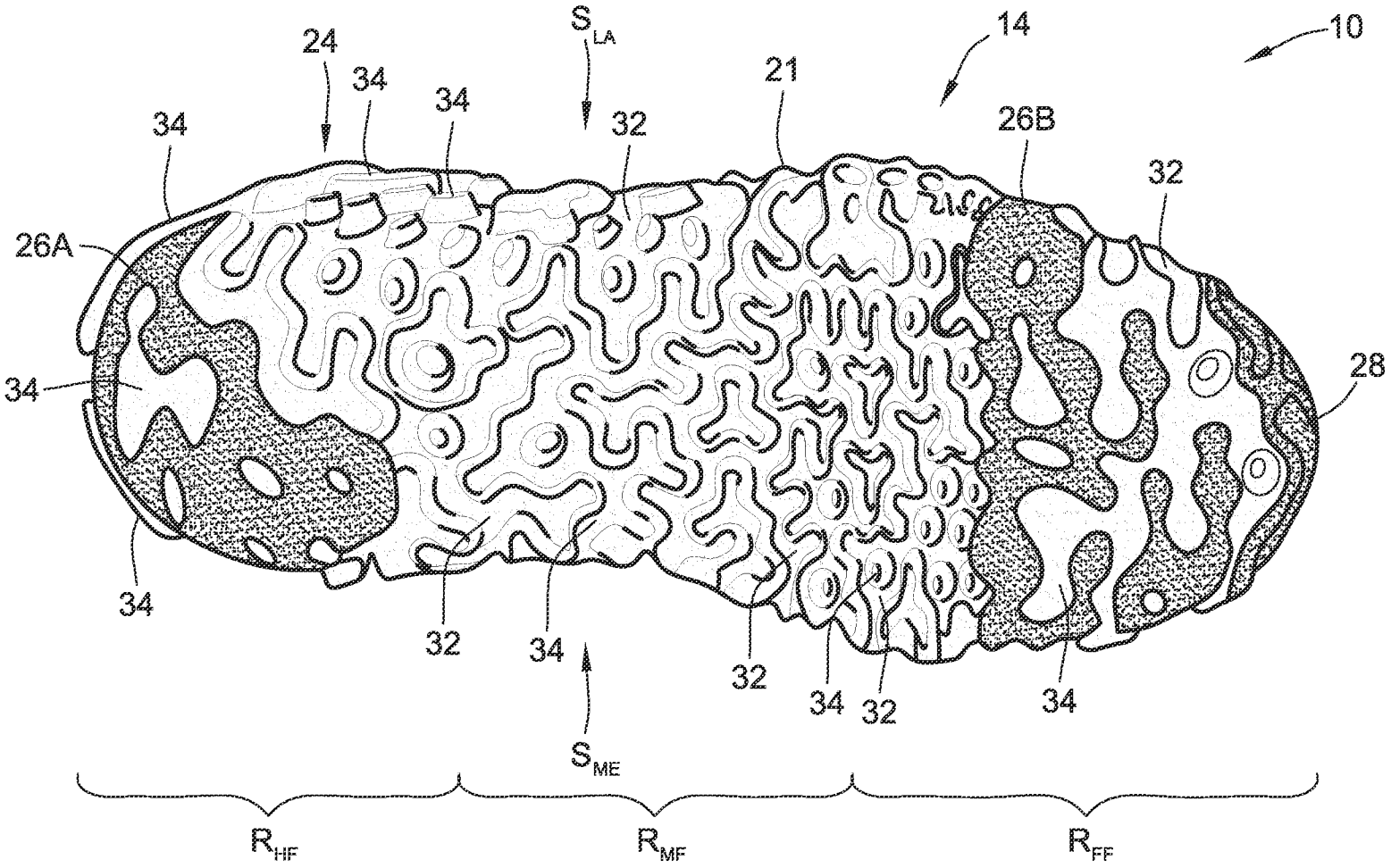
FIG. 2 is a bottom-view illustration of the representative article of footwear and multilayered sole structure assembly of FIG. 1.

The representative article of footwear 10 is generally depicted in FIGS. 1 and 2 as a bipartite construction that is primarily composed of a foot-receiving upper 12 mounted on top of a subjacent sole structure 14. For ease of reference, footwear 10 may be divided into three anatomical regions: a forefoot region $R_{FF}$, a midfoot region $R_{MF}$, and a hindfoot (heel) region $R_{HF}$, as shown in FIG. 2. Footwear 10 may also be divided along a vertical plane into a lateral segment $S_{LA}$—a distal half of the shoe 10 farthest from the sagittal plane of the human body—and a medial segment $S_{ME}$—a proximal half of the shoe 10 closest to the sagittal plane of the human body. In accordance with recognized anatomical classification, the forefoot region $R_{FF}$ is located at the front of the footwear 10 and generally corresponds with the phalanges (toes), metatarsals, and any interconnecting joints thereof. Interposed between the forefoot and hindfoot regions $R_{FF}$ and $R_{HF}$ is the midfoot region $R_{MF}$, which generally corresponds with the cuneiform, navicular and cuboid bones (i.e., the arch area of the foot). Hindfoot region $R_{HF}$, in contrast, is located at the rear of the footwear 10 and generally corresponds with the talus (ankle) and calcaneus (heel) bones. Both lateral and medial segments $S_{LA}$ and $S_{ME}$ of the footwear 10 extend through all three anatomical regions $R_{FF}$, $R_{MF}$, $R_{HF}$, and each corresponds to a respective transverse side of the footwear 10. While only a single shoe 10 for a right foot of a user is shown in FIGS. 1 and 2, a mirrored, substantially identical counterpart for a left foot of a user may be provided. Recognizably, the shape, size, material composition, and method of manufacture of the shoe 10 may be varied, singly or collectively, to accommodate practically any conventional or nonconventional footwear application.

With reference again to FIG. 1, the upper 12 is depicted as having a shell-like closed toe and heel configuration for encasing a human foot. Upper 12 of FIG. 1 is generally defined by three adjoining sections, namely a toe box 12A, a vamp 12B and a rear quarter 12C. The toe box 12A is shown as a rounded forward tip of the upper 12 that extends from distal to proximal phalanges to cover and protect the user's toes. By comparison, the vamp 12B is an arched midsection of the upper 12 that is located aft of the toe box 12A and extends from the metatarsals to the cuboid. As shown, the vamp 12B also provides a series of lace eyelets 16 and a shoe tongue 18. Positioned aft of the vamp 12B is a rear quarter 12C that extends from the transverse tarsal joint to wrap around the calcaneus bone, and includes the rear end and rear sides of the upper 12. While portrayed in the drawings as comprising three primary segments, the upper 12 may be fabricated as a single-piece construction or may be composed of any number of segments, including a toe shield 28, heel cap, ankle cuff, interior liner, etc. For sandal and slipper applications, the upper 12 may take on an open toe or open heel configuration, or may be replaced with a single strap or multiple interconnected straps.

The upper 12 portion of the footwear 10 may be fabricated from any one or combination of a variety of materials, such as textiles, engineered foams, polymers, natural and synthetic leathers, etc. Individual segments of the upper 12, once cut to shape and size, may be stitched, adhesively bonded, fastened, welded or otherwise joined together to form an interior void for comfortably receiving a foot. The individual material elements of the upper 12 may be selected and located with respect to the footwear 10 in order to impart desired properties of durability, air-permeability, wear-resistance, flexibility, appearance, and comfort, for example. An ankle opening 15 in the rear quarter 12C of the upper 12 provides access to the interior of the shoe 10. A shoelace 20, strap, buckle, or other commercially available mechanism may be utilized to modify the girth of the upper 12 to more securely retain the foot within the interior of the shoe 10 as well as to facilitate entry and removal of the foot from the upper 12. Shoelace 20 may be threaded through a series of eyelets 16 in or attached to the upper 12; the tongue 18 may extend between the lace 20 and the interior void of the upper 12.

Sole structure 14 is rigidly secured to the upper 12 such that the sole structure 14 extends between the upper 12 and a support surface upon which a user stands. In effect, the sole structure 14 functions as an intermediate support platform that separates and protects the user's foot from the ground. In addition to attenuating ground reaction forces and providing cushioning for the foot, sole structure 14 of FIGS. 1 and 2 may provide traction, impart stability, and help to limit various foot motions, such as inadvertent foot inversion and eversion. It is envisioned that the sole structure 14 may be attached to the upper 12 in any presently available or hereinafter developed suitable means. For at least some applications, the upper 12 may be coupled directly to the midsole 24 and, thus, lack a direct coupling to either the insole 22 or the outsole 26. By way of non-limiting example, the upper 12 may be adhesively attached to only an inside periphery of a midsole sidewall 21, e.g., secured with a 10 mm bonding allowance via priming, cementing, and pressing.

In accordance with the illustrated example, the sole structure 14 is fabricated as a sandwich structure with a foot-contacting insole 22 (FIG. 3), an intermediate midsole 24, and a bottom-most outsole 26. Alternative sole structure configurations may be fabricated with greater or fewer than three layers. Insole 22 is shown located within an interior void of the footwear 10, operatively located at a lower portion of the upper 12, such that the insole 22 abuts a plantar surface of the foot. Underneath the insole 22 is a midsole 24 that incorporates one or more materials or embedded elements that enhance the comfort, performance, and/or ground-reaction-force attenuation properties of footwear 10. These elements and materials may include, individually or in any combination, a polymer foam material, such as polyurethane or ethyl vinyl acetate (EVA), filler materials, moderators, air-filled bladders, plates, lasting elements, or motion control members. Outsole 26 is located underneath the midsole 24, defining only some or all of the bottom-most, ground-engaging portion of the footwear 10. The outsole 26 may be formed from a natural or synthetic rubber material that provides a durable and wear-resistant surface for contacting the ground. In addition, the outsole 26 may be contoured and textured to enhance the traction (i.e., friction) properties between footwear 10 and the underlying support surface.

Figure 3:
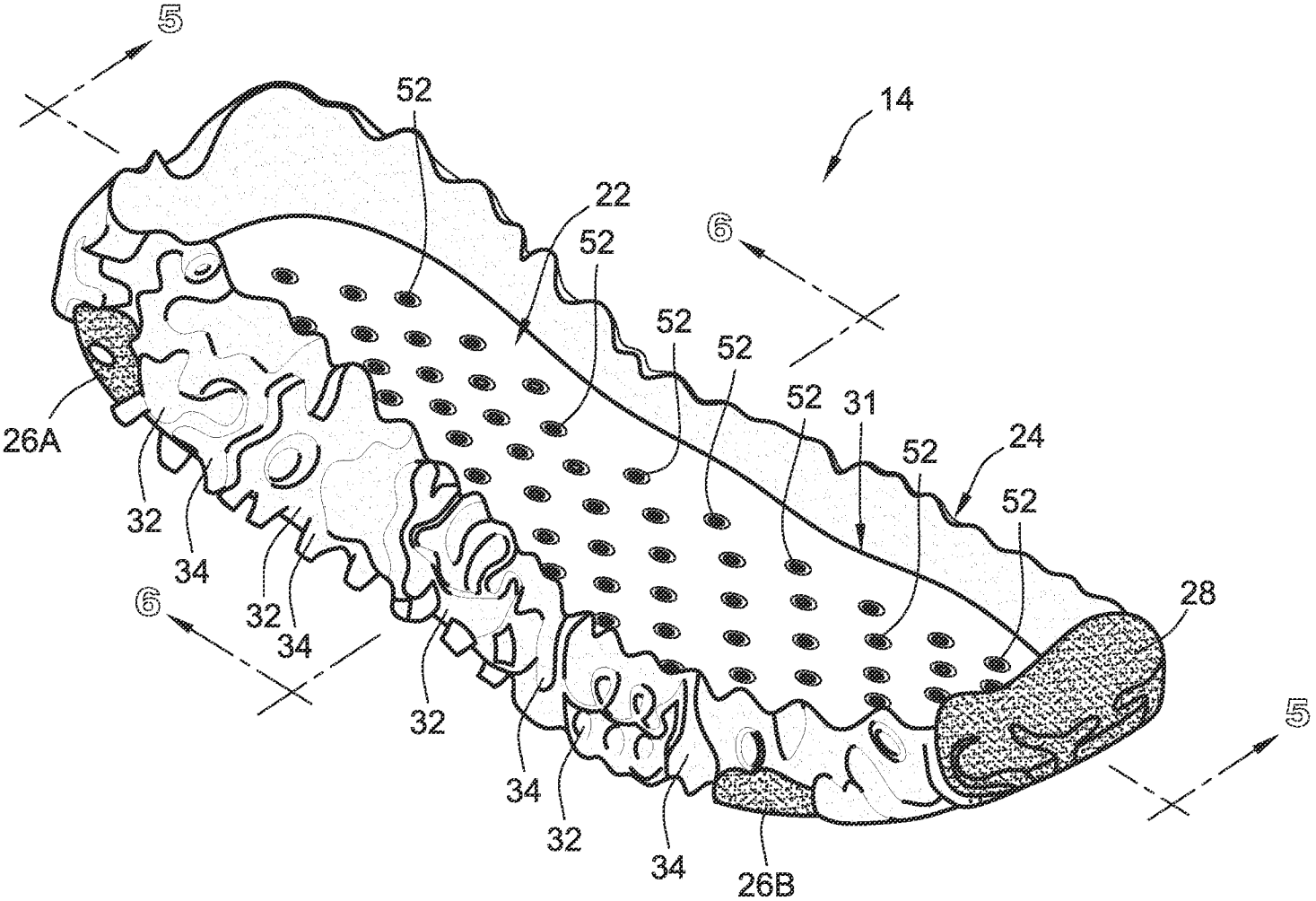
FIG. 3 is an elevated, perspective-view illustration of the sole structure assembly of FIG. 2 with the footwear upper removed.

With collective reference to FIGS. 1-3, the sole structure 14 is fabricated with the foot-cushioning insole 22 movably attached to the impact-force-attenuating midsole 24, which is formed with a pressure-mapped, outboard-facing topography and inlaid with the wear-mitigating, multipart outsole 26. In accord with the illustrated example, the midsole 24 is formed, in whole or in part, from a compressible (first) material having a relatively moderate (first) hardness, e.g., as measured according to a suitable one of the Shore Hardness Scales or other universally-recognized methodology for gauging material rigidity. The detachable insole 22, which floats on a top surface of the midsole 24, is formed, in whole or in part, from a distinct, compressible (second) material having a relatively low (second) hardness that is measurably less than that of the midsole 24. In this regard, the sole structure 14 may be characterized by a lack of an adhesive bond between the insole 22 and the midsole 24 (or any other structure, for that matter). By comparison, first and second outsole segments 26A and 26B, respectively, are rigidly mounted to the midsole 24, e.g., priming, cement adhesive, stock-fitting and pressing, and is formed, in whole or in part, from an elastic (third) material with a relatively high (third) hardness that is greater than the hardnesses of the midsole's and insole's materials.

It may be desirable, for at least some applications, that the Shore A hardness of the outsole material be larger than the Shore A hardness of the midsole material, e.g., by at least about 20% and larger than the Shore A hardness of the insole material by at least about 50%. As a non-limiting example, the midsole material may include a polymer foam material, such as thermoplastic polyurethane (TPU) foam, Phylon, Phylite, or EVA, having a material hardness in the range of about 40 to about 60 Shore A (e.g., about 65 to about 80 Asker C). Conversely, the outsole material may include an elastic polymer material, such as polyvinylchloride (PVC), hard-compound polyurethane (PU), or a polycaprolactone (PCL) or polyester-based TPU, having a material hardness of about 75 to about 90 Shore A. The insole, on the other hand, may include a softer polymer foam material, such as a lightweight polyurethane foam, having a material hardness of about 20 to about 35 Shore A. In a specific implementation, the midsole 24 is formed via compression molding as a one-piece, unitary structure from a polymer foam, such as a proprietary REACT® TPU elastomer, having a density of about 0.15 to about 0.25 g/cm$^3$. In this example, the outsole 26 is formed via blowing and cutting as a bipartite structure from a synthetic rubber, such as ethylene propylene rubber (EPR), styrene isoprene styrene (SIS) copolymer rubber, styrene butadiene rubber. Insole 22 may be formed via compression molding as a one-piece, unitary structure from a polymer foam, such as a PU foam having a specific gravity of about 0.15-0.25 and a density of less than about 0.25 g/cm$^3$.

To enhance underfoot cushioning during use of the footwear 10, while concomitantly enhancing attenuation or ground reaction forces, increasing energy return, and minimizing gross shoe weight, the midsole's outboard topography is provided with an engineered pattern of projections and cavities, the shapes, sizes, locations, and orientations of which are designed to coincide with pressure zones identified through sensor-generated pressure map data. A normative population of individuals were provided with athletic shoes retrofit with a distributed array of sensors in the sock liner. These individuals underwent pressure-map testing throughout a full day of use to chart the points along the plantar region of the foot that experiences the largest and smallest magnitudes of pressure from walking, running, frequent lateral maneuvers, and the like. The aforementioned topology parameters of the midsole were then derived through algebraic tiles applied to the resultant pressure map data to create a patterned midsole that allocates polymer foam density according to pressure magnitude distribution.

The largest concentrations of midsole 24 and outsole 26 mass may be allocated at regions of the sole structure 14 that have been determined to coincide with increased-magnitude pressure zones of the plantar region. At the same time, respective concentrations of midsole 24 and outsole 26 mass may be minimized or completely eliminated at regions of the sole structure 14 that coincide with decreased-magnitude pressure zones of the plantar region. Outwardly facing surfaces of the midsole 24, including rearward and lateral-facing surface segments of a midsole sidewall 21 and ground-facing surface segments of a midsole base 23, are formed with an assortment of recessed cavities 32 interleaved with an assortment of outwardly protruding projections 34. Each of the cavities 32 is delineated by coterminous, ground-contacting projections 34 of varying shapes, sizes and orientations. Empty cavities 32—those not occupied by a segment 26A, 26B of the outsole 26—are concentrated by volume at predetermined sections of sole structure 14 that coincide with reduced-magnitude pressure zones of the user's plantar region. To do so, however, may require each cavity 32 have a distinct shape, depth and/or width from every other cavity 32. Conversely, filled cavities 32—those occupied by a section of the outsole 26—are mapped to predetermined sections of sole structure 14 that coincide with increased-magnitude pressure zones of the plantar region. As a result of the distinctly shaped cavities 32, each projection 34 may have a distinct shape, height and/or orientation from every other projection 34. According to the illustrated example, the outsole 26 fills multiple sections of the midsole channels 34; in so doing, segments of the outsole 26 will share the shape and dimensions of the corresponding midsole channel(s) 34 in which they occupy.

By way of contrast to the outsole 26, which is rigidly mounted on and, thus, fixedly attached to the midsole 24, the insole 22 is movably mounted on and detachable from the midsole 24. That is not to say that the insole 22 is loosely laid on top of the midsole 24; rather, an adhesive-free mechanical attachment couples the insole 22 to the midsole 24 while allowing for a predetermined amount of fore-aft and medio-lateral play between the two elements. As best seen in the exploded perspective-view illustration of FIG. 4, an array of midsole protrusions 40 (also referred to herein as "first protrusions") projects upwardly from a foot-facing upper surface 25 of the midsole 24, which is opposite a ground-facing lower midsole surface 27 (FIG. 1). While it is envisioned that the protrusions 40 may take on assorted combinations of shapes, sizes, and orientations, each protrusion 40 of FIG. 4 has a prolate-spheroid shaped body 41 with a rectangular base 43 (see lower inset view of FIG. 4). A prolate-spheroid shape may provide added underfoot comfort, e.g., as compared to blunt ended or sharp pointed protrusions. The midsole protrusions 40 may be approximately 1.0-4.0 mm high, as measured from the base 43, and may project generally perpendicular from the upper midsole surface 25. It may be desirable, for at least some applications, that the midsole 24 includes at least about fifty protrusions 40 or, for at least some applications, at least about seventy protrusions 40 depending, for example, on the shoe size of the footwear 10.

Figure 4:
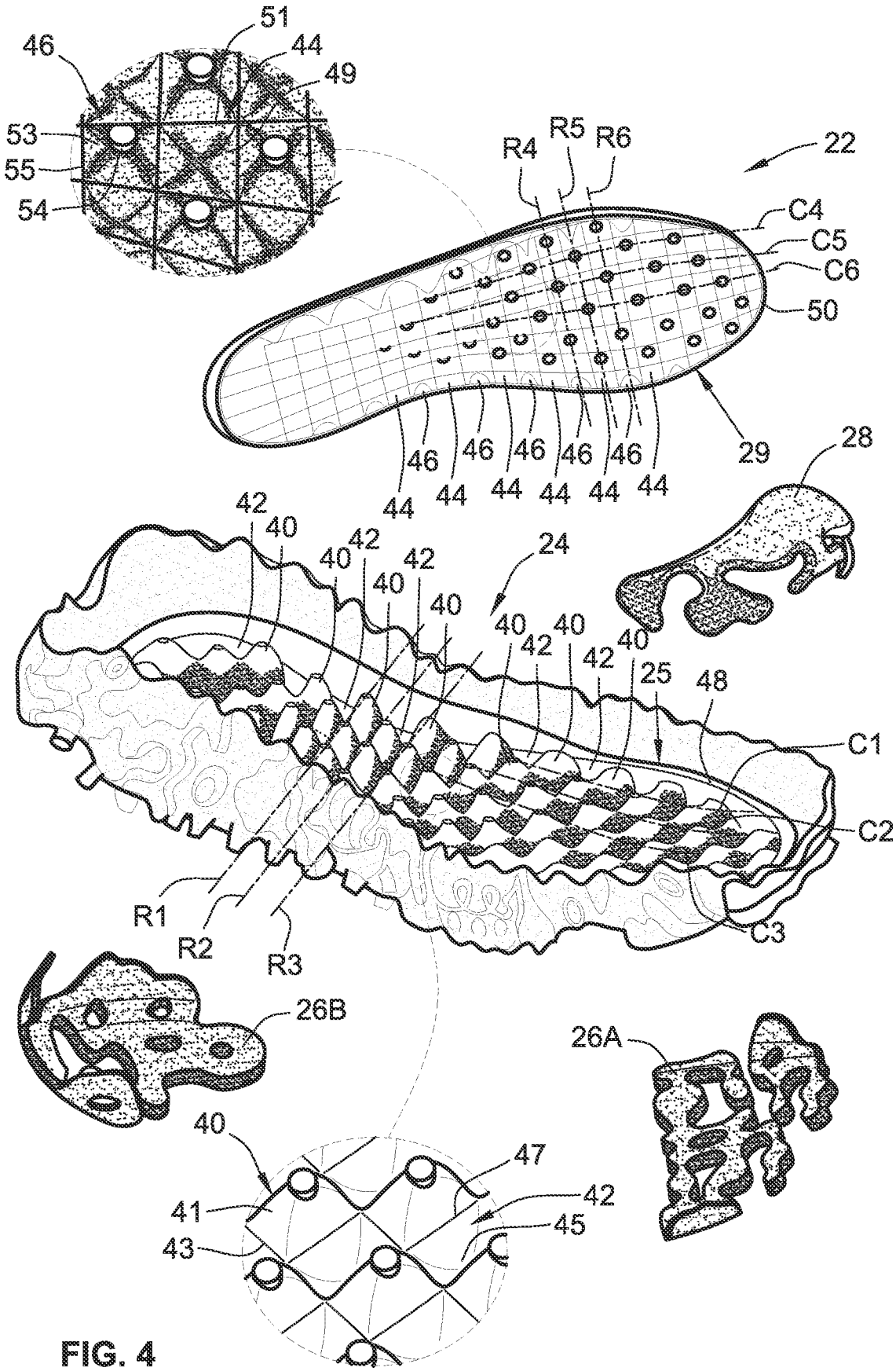
FIG. 4 is an exploded, perspective-view illustration of the sole structure assembly of FIG. 3 with the insole partially inverted to show the insole's lower surface.

Interleaved with the midsole's protrusions 40 is an array of midsole pockets 42 (also referred to herein as "first pockets") recessed into the upper midsole surface 25. Like the midsole protrusions 40, the pockets 42 may take on assorted combinations of shapes, sizes, and orientations; pockets 42 of FIG. 4 are portrayed as having a prolate-spheroid shaped cavity 45 with a rectangular window 47. These midsole pockets 42 may be approximately 1.0-3.0 mm deep, as measured from the window 47. In accord with the illustrated architecture, each of the pockets 42 may neighbor and be delineated by multiple coterminous protrusions 40. As shown, the midsole protrusions 40 and pockets 42 are arranged in a series of mediolateral rows—represented herein by first, second and third rectilinear rows R1-R3 of FIG. 4—extending transversely across the midsole 24 and, thus the sole structure 14. Optionally, the midsole protrusions 40 and pockets 42 may also be arranged in a series of fore-aft columns—represented herein by first, second and third curvilinear columns C1-C3 of FIG. 4—extending longitudinally across the midsole 24 and, thus the sole structure 14. It may be desirable, for at least some applications, that the midsole 24 includes at least about fifty pockets 42 or, for at least some applications, at least about seventy pockets 42. The protrusions 40 and pockets 42 may cooperatively cover at least about 60-70% of the midsole's 24 upper surface 25.

To provide a complementary interface for mechanically attaching to the midsole 24, the insole 22 has a ground-facing lower surface 29, opposite a foot-facing upper insole surface 31 (FIG. 3), with multiple insole protrusions 44 (also referred to herein as "second protrusions") projecting downwardly therefrom. Similar to the midsole protrusions 40, insole protrusions 44 may take on various combinations of shapes, sizes, and orientations; each protrusion 44, for example, has a prolate-spheroid shaped body 49 with a rectangular base 51 (see upper inset view of FIG. 4). The insole protrusions 44 may be approximately 1.0-3.0 mm high, as measured from the base 51, and may project generally perpendicular from the lower insole surface 27. It may be desirable, for at least some applications, that the insole 24 includes at least about fifty protrusions 44 or, for at least some applications, at least about seventy protrusions 44, e.g., to coincide with the number of midsole pockets 42.

Multiple insole pockets 46 (also referred to herein as "second pockets") are recessed into the lower insole surface 29, interleaved with the insole protrusions 44. Similar to the midsole pockets 42, the insole pockets 46 may take on assorted combinations of shapes, sizes, and orientations; pockets 46 of FIG. 4 are portrayed as having a prolate-spheroid shaped cavity 53 with a rectangular window 55. Generally speaking, the inner periphery of each midsole/insole pocket 42, 46 coincides with the outer periphery of a respective insole/midsole protrusion 44, 40 of the opposing shoe structure element. For instance, the insole pockets 46 may be approximately 1.0-4.0 mm deep, as measured from the window 47, to match the heights of the midsole protrusions 40. With this arrangement, each insole pocket 46 may neighbor and be delineated by multiple coterminous insole protrusions 44. It may be desirable, for at least some applications, that the insole 24 includes at least about fifty pockets 46 or, for at least some applications, at least about seventy pockets 46, e.g., to coincide with the number of midsole protrusions 40. The protrusions 44 and pockets 46 may cooperatively cover at least about 80-90% of the insole's 22 lower surface 29.

As shown, the insole protrusions 44 and pockets 46 are arranged in a series of mediolateral rows—represented herein by fourth, fifth and sixth rectilinear rows R4-R6 of FIG. 4—extending transversely across the insole 22 and, thus, the sole structure 14. The illustrated mediolateral rows of the insole 22 (e.g., rows R4-R6) are parallel to one another and, for at least the illustrated embodiment, parallel with the mediolateral rows of the midsole 24 (e.g., rows R1-R3). As a further option, the insole protrusions 44 and pockets 46 may also be arranged in a series of fore-aft columns—represented herein by fourth, fifth and sixth curvilinear columns C4-C6 of FIG. 4—that extend longitudinally across the insole 22. Each fore-aft insole column (e.g., columns C4-C6) may be aligned with a respective one of the fore-aft midsole columns (e.g., columns C1-C3).

Figure 5:
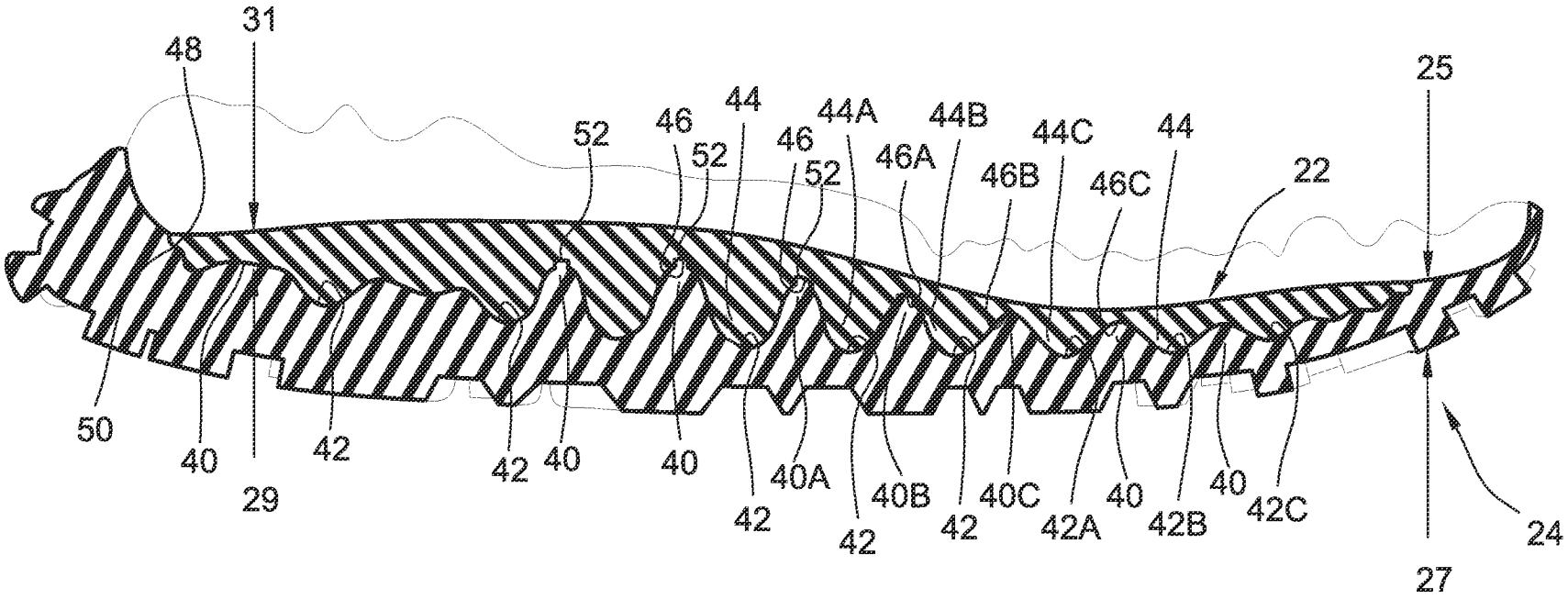
FIG. 5 is a longitudinal cross-sectional illustration of the representative insole and midsole of the sole structure assembly of FIG. 1 taken along line 5-5 of FIG. 3.
Figure 6:
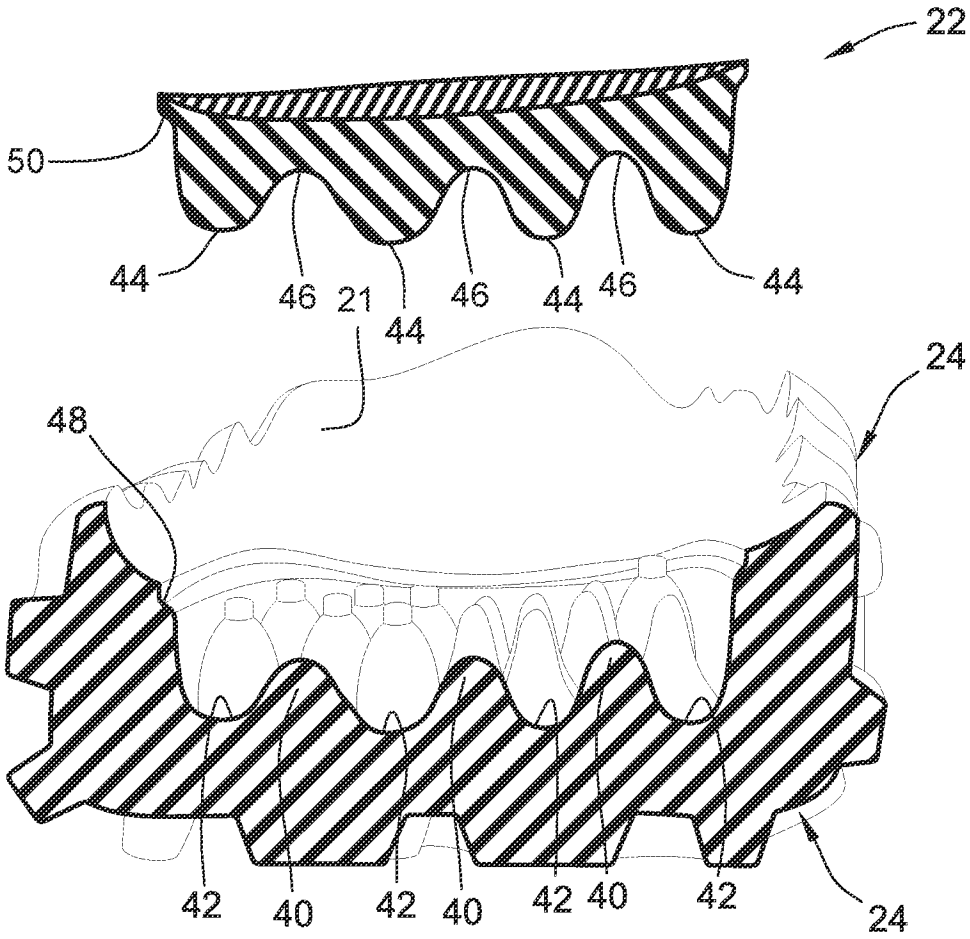
FIG. 6 is a transverse cross-sectional illustration of the representative insole and midsole of the sole structure assembly of FIG. 1 taken along line 6-6 of FIG. 3.

When properly mated, the insole 22 and midsole 24 intermesh via complementary "egg-crate" geometries with the midsole protrusions 40 inserted alternatively between the insole protrusions 44. Concomitantly, each midsole protrusion 40 seats inside and is surrounded by a respective insole pocket 46, while each insole protrusion 44 seats inside and is surrounded by a respective midsole pocket 42. With this configuration, most of the midsole protrusions 40 will be neighbored on three or four sides thereof by insole protrusions 44, while most of the insole protrusions 44 will be neighbored on three or four sides thereof by midsole protrusions 40, as best seen in FIGS. 5 and 6. According to the illustrated example, each midsole protrusion 40 sits substantially flush against its corresponding insole pocket 46, and each insole protrusion 44 sits substantially flush against its corresponding midsole pocket 42. Additional subjacent support for the insole 22 may be provided by a stepped shelf 48 that is integrally formed into the midsole 24 and extends substantially continuously around the portion of the upper midsole surface 25 against which the insole 22 abuts. A flange 50 is integrally formed into and projects transversely from the insole 22, extending substantially continuously around the lower insole surface 29. Once properly aligned, the flange 50 of the insole 22 is buttressed on the stepped shelf 48 of the midsole 24.

With reference again to FIGS. 5 and 6, a plurality of the midsole protrusions 40 may have distinct heights and widths. In FIG. 5, for example, a large midsole protrusion 40A is shown to be wider and taller than a medium midsole protrusion 40B, which is shown to be taller yet thinner than a small midsole protrusion 40C. The heights of the midsole protrusions 40 may progressively increase in a fore-aft direction from the front of the shoe 10 (e.g., forefoot region $R_{FF}$ of FIG. 2) to the middle of the shoe 10 (e.g., midfoot region $R_{MF}$), and thereafter progressively decrease from the middle to the rear of the shoe (e.g., midfoot to hindfoot region $R_{MF}$, $R_{HF}$). The heights of the midsole protrusions 40 may also progressively increase and decrease in a mediolateral direction from side-to-side of the shoe 10 (e.g., traversing across the lateral and medial segments $S_{LA}$ and $S_{ME}$ from top-to-bottom and bottom-to-top in FIG. 2). The foregoing description may be similarly applicable to the midsole pockets 42, as represented by the large, medium and small pockets 42A, 42B and 42C, respectively, in FIG. 5.

Similar to the midsole protrusions 40, many of the insole protrusions 44 may have distinct heights and widths from one another. In FIG. 5, for example, a large insole protrusion 44A is shown to be taller yet thinner than a medium insole protrusion 44B; medium insole protrusion 44B, in turn, is taller yet thinner than a small insole protrusion 44C. In the same vein, the heights of the insole protrusions 44 may progressively increase in a fore-aft direction from the front of the shoe 10 (e.g., forefoot region $R_{FF}$) to the middle of the shoe 10 (e.g., midfoot region $R_{MF}$), and thereafter progressively decrease from the middle to the rear of the shoe (e.g., midfoot region $R_{MF}$ to hindfoot region $R_{HF}$). Further coinciding with the midsole protrusions 40, the heights of the insole protrusions 44 may also progressively increase and decrease in a mediolateral direction from side-to-side of the shoe 10. The foregoing description may be similarly applicable to the insole pockets 46, as represented by the large, medium and small insole pockets 46A, 46B and 46C, respectively, in FIG. 5.

A subset of the midsole protrusions 40 each includes an integrally formed nub 52 that projects upwardly from a distal tip thereof. These midsole protrusion nubs 52 may be fabricated in a variety of shapes in sizes; as best seen in the lower inset view of FIG. 4, each nub 52 may be formed with a cylindrical body with a rounded tip at a distal end of the cylindrical body. Likewise, a corresponding subset of the insole pockets 46 each includes a respective through hole 54 that extends through the insole 22 and receives therein a respective one of the midsole protrusion nubs 52. As shown, each nub 52 extends through a corresponding insole pocket hole 54, from the lower insole surface 29 to the upper insole surface 31. The nubs are arranged in an engineered pattern that gives a "foot massaging" proprioceptive response for a user of the footwear 10. While not per se required, the insole pocket holes 54 may be narrower than the width/diameter of the midsole protrusion nubs 52 such that press fitting the nubs 52 into the holes 54 creates an interference fit coupling between the insole 22 and midsole 24.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A sole structure for an article of footwear, the sole structure comprising:

a midsole including a first compressible material having a first hardness, the midsole having a ground-facing lower midsole surface, an upper midsole surface opposite the lower midsole surface, multiple first protrusions projecting from the upper midsole surface and having a first prolate-hemispheroid shape, and multiple first pockets recessed into the upper midsole surface and interleaved with the first protrusions, wherein the first protrusions each has a respective first height distinct from respective first heights of other ones of the first protrusions; and an insole movably mounted on the midsole and including a second compressible material having a second hardness distinct from the first hardness, the insole having a midsole-facing lower insole surface, an upper insole surface opposite the lower insole surface, multiple second protrusions projecting from the lower insole surface and having a second prolate-hemispheroid shape, and multiple second pockets recessed into the lower insole surface and interleaved with the second protrusions, the first protrusions each nesting within a respective one of the second pockets, and the second protrusions each nesting within a respective one of the first pockets, wherein the second protrusions each has a respective second height distinct from respective second heights of other ones of the second protrusions, wherein the sole structure is characterized by a lack of an adhesive material and a fastener attaching the insole and the midsole.

2. The sole structure of claim 1, wherein the first pockets of the midsole include first prolate-hemispheroid shaped cavities complementary to the second prolate-hemispheroid shape of the second protrusions, and the second pockets of the insole include second prolate-hemispheroid shaped cavities complementary to the first prolate-hemispheroid shape of the first protrusions.

3. The sole structure of claim 2, wherein the first prolate-hemispheroid shaped cavities each has a first rectangular window through which is received a respective one of the second protrusions, and the second prolate-hemispheroid shaped cavities each has a second rectangular window through which is received a respective one of the first protrusions.

4. The sole structure of claim 1, wherein the first prolate-hemispheroid shape of the first protrusions has a first rectangular base, and the second prolate-hemispheroid shape of the second protrusions has a second rectangular base.

5. A sole structure for an article of footwear, the sole structure comprising:

a midsole including a first compressible material having a first hardness, the midsole having a ground-facing lower midsole surface, an upper midsole surface opposite the lower midsole surface, multiple first protrusions projecting from the upper midsole surface and having a first prolate-hemispheroid shape, and multiple first pockets recessed into the upper midsole surface and interleaved with the first protrusions, wherein the first protrusions each has a respective first width distinct from respective first widths of other ones of the first protrusions; and an insole movably mounted on the midsole and including a second compressible material having a second hardness distinct from the first hardness, the insole having a midsole-facing lower insole surface, an upper insole surface opposite the lower insole surface, multiple second protrusions projecting from the lower insole surface and having a second prolate-hemispheroid shape, and multiple second pockets recessed into the lower insole surface and interleaved with the second protrusions, the first protrusions each nesting within a respective one of the second pockets, and the second protrusions each nesting within a respective one of the first pockets, wherein the second protrusions each has a respective second width distinct from respective second widths of other ones of the second protrusions.

6. The sole structure of claim 1, wherein the first protrusions each has a respective first width distinct from respective first widths of other ones of the first protrusions, and wherein the second protrusions each has a respective second width distinct from respective second widths of other ones of the second protrusions.

7. The sole structure of claim 1, wherein the first protrusions each sits substantially flush against the respective one of the second pockets, and the second protrusions each sits substantially flush against the respective one of the first pockets.

8. The sole structure of claim 1, wherein the first protrusions and the first pockets are arranged in a first plurality of mediolateral rows extending transversely across the midsole, and the second protrusions and the second pockets are arranged in a second plurality of mediolateral rows extending transversely across the insole.

9. The sole structure of claim 1, wherein one or more of the first protrusions of the midsole each includes a respective nub, and wherein one or more of the second pockets of the insole each includes a respective hole receiving therein a respective one of the nubs.

10. The sole structure of claim 9, wherein each of the holes in the insole have a first width, and wherein each of the nubs of the first protrusions have a second width greater than the first width such that each of the nubs is press fit into the respective one of the holes and thereby creates an interference fit coupling between the insole and midsole.

11. The sole structure of claim 1, wherein the midsole includes a stepped shelf extending substantially continuously around the upper midsole surface, the insole includes a flange extending substantially continuously around the lower insole surface, and the flange is buttressed on the stepped shelf.

12. The sole structure of claim 1, further comprising an outsole including a third material having a third hardness distinct from the first and second hardnesses, the outsole being mounted to the ground-facing lower midsole surface.

13. The sole structure of claim 12, wherein the outsole is a bipartite structure and the third material includes a synthetic rubber.

14. The sole structure of claim 1, wherein the first compressible material is a first polymer foam and the midsole is molded as a first single-piece structure from the first polymer foam, and wherein the second compressible material is a second polymer foam, distinct from the first polymer foam, and the insole is molded as a second single-piece structure from the second polymer foam.

15. A sole structure for an article of footwear, the sole structure comprising:

a midsole including a first compressible material having a first hardness, the midsole having a ground-facing lower midsole surface, an upper midsole surface opposite the lower midsole surface, multiple first protrusions projecting from the upper midsole surface and having a first prolate-hemispheroid shape, and multiple first pockets recessed into the upper midsole surface and interleaved with the first protrusions, wherein one or more of the first protrusions of the midsole each includes a respective nub; and an insole movably mounted on the midsole and including a second compressible material having a second hardness distinct from the first hardness, the insole having a midsole-facing lower insole surface, an upper insole surface opposite the lower insole surface, multiple second protrusions projecting from the lower insole surface and having a second prolate-hemispheroid shape, and multiple second pockets recessed into the lower insole surface and interleaved with the second protrusions, the first protrusions each nesting within a respective one of the second pockets, and the second protrusions each nesting within a respective one of the first pockets, wherein one or more of the second pockets of the insole each includes a respective hole receiving therein a respective one of the nubs, wherein each of the holes has a first width and each of the nubs has a second width greater than the first width such that each of the nubs is press fit into the respective one of the holes to thereby create an interference fit coupling between the insole and midsole.

16. The sole structure of claim 5, wherein the first protrusions each has a respective first height distinct from respective first heights of other ones of the first protrusions, and wherein the second protrusions each has a respective second height distinct from respective second heights of other ones of the second protrusions.

17. The sole structure of claim 5, wherein the first pockets of the midsole include first prolate-hemispheroid shaped cavities complementary to the second prolate-hemispheroid shape of the second protrusions, and the second pockets of the insole include second prolate-hemispheroid shaped cavities complementary to the first prolate-hemispheroid shape of the first protrusions.

18. The sole structure of claim 17, wherein the first prolate-hemispheroid shaped cavities each has a first rectangular window through which is received a respective one of the second protrusions, and the second prolate-hemispheroid shaped cavities each has a second rectangular window through which is received a respective one of the second protrusions.

19. The sole structure of claim 5, wherein the first prolate-hemispheroid shape of the first protrusions has a first rectangular base, and the second prolate-hemispheroid shape of the second protrusions has a second rectangular base.

20. The sole structure of claim 5, wherein the first protrusions and the first pockets are arranged in a first plurality of mediolateral rows extending transversely across the midsole, and the second protrusions and the second pockets are arranged in a second plurality of mediolateral rows extending transversely across the insole.

* * * * *